US006866352B2

(12) United States Patent
Fujii et al.

(10) Patent No.: US 6,866,352 B2
(45) Date of Patent: Mar. 15, 2005

(54) SHELF APPARATUS FOR SHOWCASE

(75) Inventors: Kiyoshi Fujii, Seta-gun (JP); Nobuo Kanbayashi, Kodama-gun (JP); Akifumi Kanouchi, Isesaki (JP); Shoichi Yamazaki, Maebashi (JP)

(73) Assignee: Sanden Corp., Gunma (JP)

( * ) Notice: Subject to any disclaimer, the term of this patent is extended or adjusted under 35 U.S.C. 154(b) by 0 days.

(21) Appl. No.: 10/379,900

(22) Filed: Mar. 6, 2003

(65) Prior Publication Data

US 2003/0173876 A1 Sep. 18, 2003

(30) Foreign Application Priority Data

Mar. 18, 2002 (JP) ..... 2002-074532

(51) Int. Cl.[7] ..... A47F 3/06

(52) U.S. Cl. ..... 312/122; 312/114; 312/126; 312/333; 312/334.1; 108/102

(58) Field of Search ..... 312/114, 116, 312/122, 126, 351, 330.1, 333, 334.1; 108/93, 102, 137

(56) References Cited

U.S. PATENT DOCUMENTS 2,199,881 A * 5/1940 Hedlund ..... 62/300
2,769,551 A * 11/1956 Just ..... 211/59.2
3,311,072 A * 3/1967 Pattison ..... 108/143
4,191,436 A * 3/1980 Cherry ..... 312/334.11
4,460,222 A * 7/1984 Larking ..... 312/286
5,531,159 A * 7/1996 Stubblefield ..... 108/102
5,673,801 A * 10/1997 Markson ..... 211/59.3
5,749,478 A * 5/1998 Ellis ..... 211/59.2
6,164,462 A * 12/2000 Mumford ..... 211/59.2

FOREIGN PATENT DOCUMENTS

JP 2529051 Y 12/1996
JP 2000035277 A * 2/2000
JP 2001037598 A * 2/2001
JP 2003210288 A * 7/2003

* cited by examiner

*Primary Examiner*—Peter M. Cuomo
*Assistant Examiner*—Joseph Edell
(74) *Attorney, Agent, or Firm*—Banner & Witcoff, Ltd.

(57) ABSTRACT

A shelf apparatus for a showcase includes a shelf plate; a shelf support for supporting the shelf plate; and a connecting member having a movable portion and a fixed portion connected to the shelf plate and the shelf support, respectively. The movable portion has a hard locking member, and the shelf support has a concave portion which can lock and unlock the locking member. When the shelf plate is held on the shelf supports, the locking member is locked to the concave portion. When commodities are resupplied onto the shelf plate, the locking member is unlocked from the concave portion. Thereby, the movable portion of the connecting member is detached from the shelf support. Then, the shelf plate is pulled out forward and commodities are resupplied onto the pulled-out shelf plate.

5 Claims, 5 Drawing Sheets

SHELF APPARATUS FOR SHOWCASE

BACKGROUND OF THE INVENTION

1. Field of the Invention

The present invention relates to a shelf apparatus provided in tiers in a showcase and, more particularly, to a shelf apparatus in which a shelf plate can be stored on shelf supports and the shelf plate can be pulled out forward.

2. Description of the Related Art

Conventionally, as a shelf apparatus for an open showcase, a shelf apparatus described in Japanese Utility Model Gazette No. 2529051 is publicly known.

This shelf apparatus has a shelf plate on which commodities are placed. Also, the shelf apparatus has shelf supports which support the shelf plate so that the shelf plate is inclined in such a manner that the front end of shelf plate lowers. Further, the shelf apparatus has a connecting member for connecting the shelf plate to the shelf support. This connecting member connects the shelf plate to the shelf support so that the shelf plate can slide in the depth direction with respect to the shelf support.

When commodities are resupplied onto the shelf plate stored on the shelf supports, the work is performed by the procedure described below. First, the front end of shelf plate is grasped by hands and is pulled out forward. Then, commodities to be resupplied are placed on the shelf plate. Subsequently, the front end of the shelf plate onto which commodities have been resupplied is grasped by hands and is pushed back. Thereby, the shelf plate onto which commodities have been resupplied is fixed on the shelf supports again, thereby completing the resupply work.

A shelf apparatus for a showcase of a type such that the shelf plate is supported horizontally, not to mention a type such that the shelf plate is supported so as to be inclined slantwise forward (the above-described conventional shelf apparatus), must have such a construction that the shelf plate is not pulled out forward inadvertently. Therefore, the shelf apparatus of these types are provided with a regulating member for regulating a movement of the shelf plate, for example, a plate spring member provided on the shelf support.

Specifically, when the shelf plate is supported on the shelf supports, a tip end of the plate spring member is hooked to a front end of the shelf plate to regulate a forward movement of shelf plate. When the shelf plate is pulled out forward, the plate spring member is pushed to be opened so that the plate spring member is detached from the front end of the shelf plate, thereby a regulation of a shelf plate movement is released. By this operation of the plate spring member, the shelf plate is held on the shelf supports, or the shelf plate is pulled out forward.

However, an elastic force of the plate spring member thereof may be gradually weakened by a continuous use, and finally the plate spring member may be lose its shelf plate holding function. Therefore, the plate spring member may be unsuitable for stable use for a long period of time.

SUMMARY OF THE INVENTION

The present invention has been achieved to solve the above problem, and accordingly an object thereof is to provide a shelf apparatus for a showcase, which can be used stably in a continuous manner as a regulating member for regulating a movement of a shelf plate.

To attain the above object, the present invention provides a shelf apparatus for a showcase, including a shelf plate on which commodities are placed; a shelf support on which the shelf plate is supported; and a connecting member having a movable portion connected to the shelf plate and a fixed portion connected to the shelf support for enabling the shelf plate to slide in the depth direction, wherein one of the movable portion of the connecting member and the shelf support has a hard locking member, and the other has a locked portion which can lock and unlock the locking member.

According to the present invention, when the shelf plate is held on the shelf supports (when the shelf plate is in a stored state), the locking member is locked to the locked portion. Thereby, the shelf plate is fixed to the shelf support via the connecting member. On the other hand, when commodities are resupplied onto the shelf plate, the locking member is unlocked from the locked portion. Thereby, the movable portion of the connecting member is detached from the shelf support. Then, the shelf plate is pulled out forward while the shelf plate is grasped by hand, and commodities are resupplied onto the pulled-out shelf plate.

The above and other objects, features, and advantages of the present invention will be apparent from the ensuing description and accompanying drawings.

DESCRIPTION OF THE PREFERRED EMBODIMENTS

FIGS. 1 to 6A, 6B and 6C show one embodiment of a shelf apparatus for a showcase in accordance with the present invention.

Figure 1:
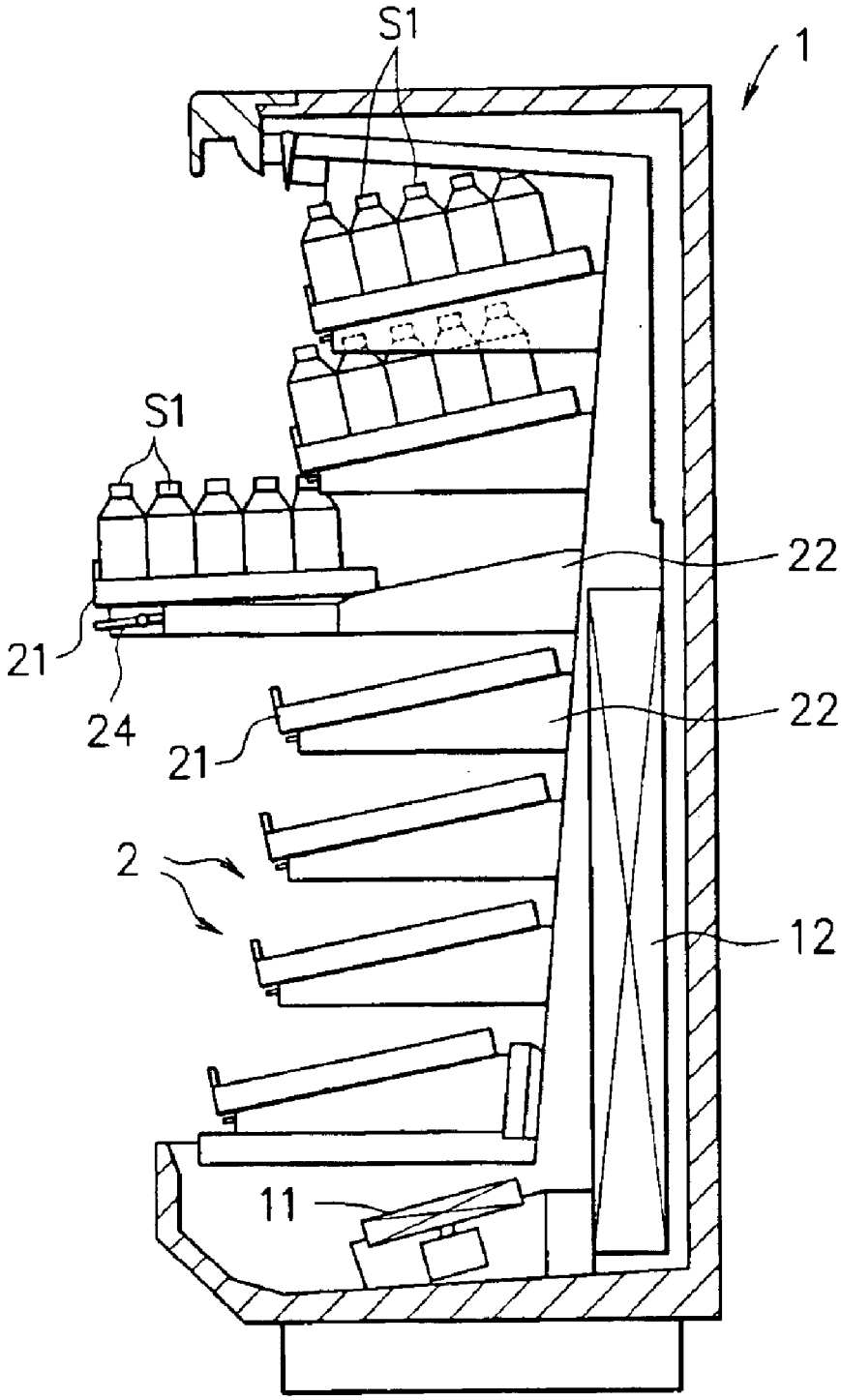
FIG. 1 is a side sectional view of an open showcase.

First, a construction of the showcase will be explained briefly with reference to FIG. 1. The showcase shown in the drawing is a multi-tier open showcase 1 (hereinafter referred to as a showcase 1), in which seven shelf apparatuses 2 are arranged therein. Also, bottled commodities S1 are placed on the shelf apparatus 2. When the commodities S1 are ones requiring refrigeration, the interior of the showcase 1 is cooled by cooling equipment (an in-case circulation fan 11, a cooler 12).

Next, a construction of the shelf apparatus 2 provided in seven tiers in the showcase 1 will be explained with reference to FIGS. 2 to 6A, 6B, 6C. The shelf apparatus 2 has a shelf plate 21 on which the commodities S1 are placed and plate-like shelf supports 22 for supporting the right and left of a lower surface of the shelf plate 21, and a connecting member 23 for connecting the shelf supports 22 to the shelf plate 21.

Figure 2:
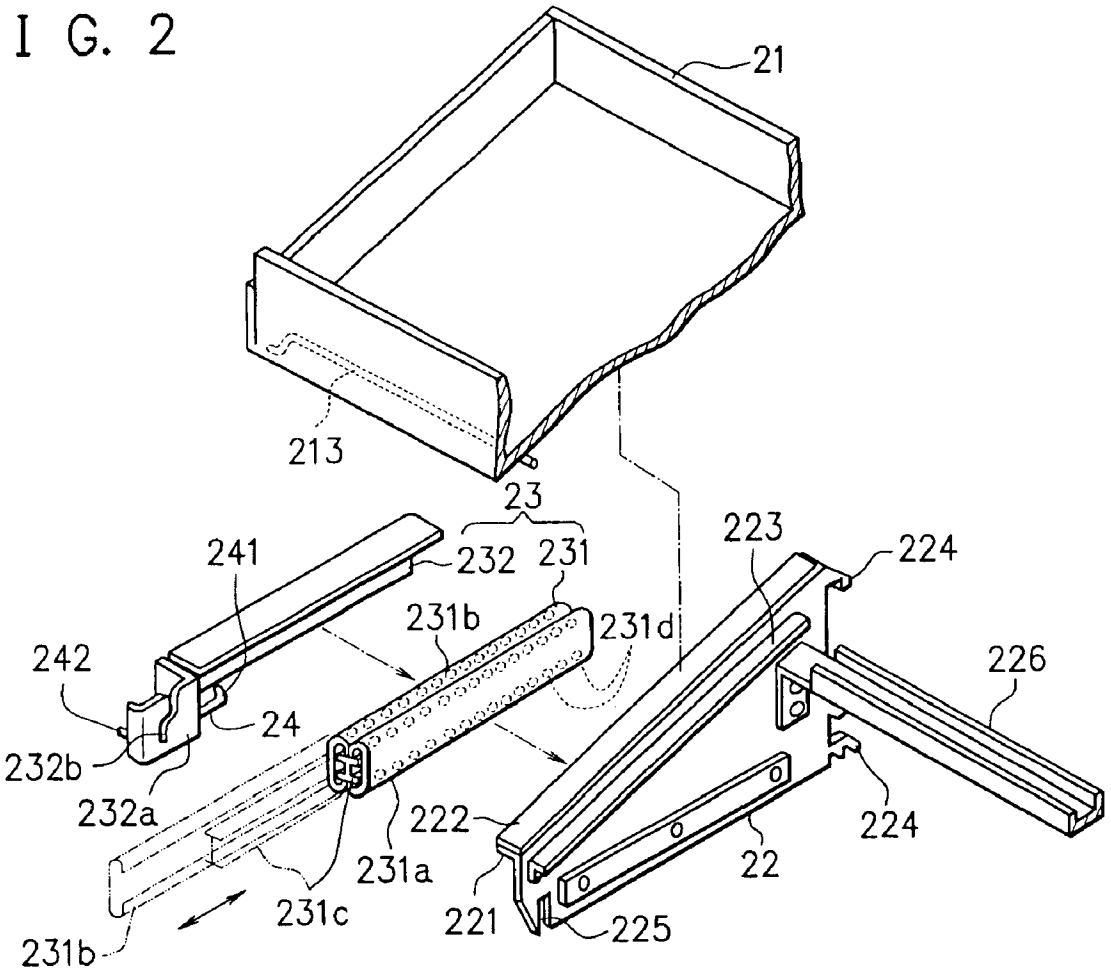
FIG. 2 is an exploded perspective view of a shelf apparatus.
Figure 3:
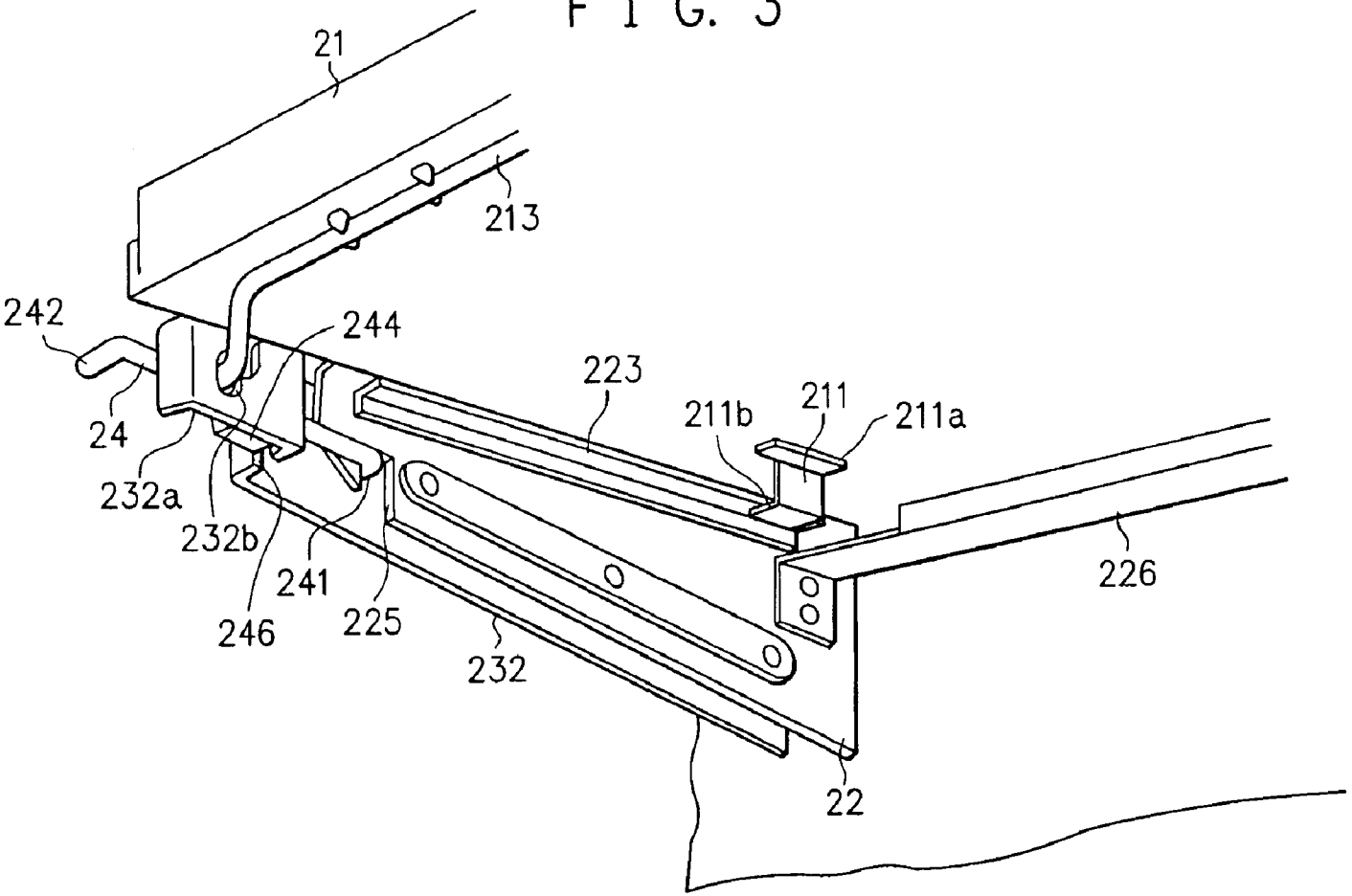
FIG. 3 is a general perspective view of a shelf apparatus.

The shelf plate 21 is formed as a flat box shape, whose upper face is open, and as shown in FIG. 3, a holding member 211 for preventing the shelf plate 21 from coming off is provided at the right and left on the rear side of the lower surface of the shelf plate 21. Although FIG. 3 shows only the holding member 211 on the left side of the shelf plate 21, the similar holding member 211 is also provided on the right side of the shelf plate 21. This holding member 211 is composed of an upper plate 211*a* and a coming-off preventing plate 211*b* formed under the upper plate 211*a*. Since the upper plate 211*a* is fixed to the back surface of the shelf plate 21, the coming-off preventing plate 211*b* is in a state of being hung from the shelf plate 21. The coming-off preventing plate 211*b* is formed into an L shape in cross section, and the lower end of the coming-off preventing plate 211*b* is located under an upper plate of a shelf guide plate 223, described later. Thereby, even if the rear end of the shelf plate 21 is floated by a shock etc. from the outside, the coming-off preventing plate 211*b* collides with the shelf guide plate 223, so that the rear portion of the shelf plate 21 is prevented from coming off the shelf support 22. Also, as shown in FIGS. 2 and 3, a locking wire 213 is provided on the lower surface of the shelf plate 21. The locking wire 213 extends over the total width in the transverse direction on the front side of the shelf plate 21. Both end portions, right and left, of the locking wire 213 are bent into an L shape, and these bent portions are locked to or unlocked from a locking grooves 232*b*, described later.

The shelf support 22 is formed slantwise so that the upper end thereof lowers toward the front end. Although FIGS. 2 and 3 show only the left-hand side shelf support 22, the similar shelf support 22 is also provided on the right side. By this inclination of the shelf support 22, the shelf plate 21 supported on the shelf support 22 is also placed in a state of being inclined slantwise toward the front in the same way. By forwardly inclining the shelf plate 21 in this manner, when commodities S on the foremost row are sold, the following rear commodities S1 can be slid forward successively.

As shown in FIG. 2, an upper end portion of the shelf support 22 is bent at right angles toward the outside, and on a bent plate 221 is provided a slide plate 222, and the shelf plate 21 placed on the slide plates 222 slides smoothly. Also, on the side face on the inside of the shelf support 22 is provided the shelf guide plate 223 extending in the depth direction along the upper end of the shelf support 22. An upper end portion of the shelf guide plate 223 is bent toward the inside, and the lower plate of the coming-off preventing plate 211*b* is located under the shelf guide plate 223 as described above so that the coming-off preventing plate 211*b* is guided along the shelf guide plate 223. Also, a plurality of hooks 224 are formed so as to be arranged vertically at the rear end of the shelf support 22. These hooks 224 are engaged with predetermined hook holes of many hook holes formed in a shelf pillar, not shown, by which an installation position (height position) of the shelf apparatus 2 is determined.

On the front end side of the shelf support 22, a locked portion, for example, a concave portion 225 is formed as shown in FIGS. 2 and 3. This concave portion 225 is formed by being cut into a square shape from the lower end of the shelf support 22 toward the upside, and a locking portion 241 of a locking member 24, described later, can be locked to and unlocked from the concave portion 225.

The right and left shelf supports 22 on which the shelf plate 21 is placed are connected to each other by a connecting frame 226. Thereby, the right and left shelf supports 22 can be set easily at the same height positions.

As shown in FIG. 2, a connecting member 23 is composed of a sliding mechanism 231 extending in the depth direction and a connecting plate 232. The sliding mechanism 231 is a well known mechanism, in which an intermediate plate 231*c* is interposed between a fixed plate 231*a* and a movable plate 231*b*. Bearings 231*d* are interposed between the intermediate plate 231*c* and the fixed plate 231*a* and between the intermediate plate 231*c* and the movable plate 231*b*. Thereby, the movable plate 231*b* is slid in the depth direction as indicated by a double-headed arrow in FIG. 2.

On the other hand, the connecting plate 232 extends in the depth direction, and is formed so as to cover the side face and upper face of the sliding mechanism 231. The movable plate 231*b* of the sliding mechanism 231 is fixed on the side face of the connecting plate 232. Thereby, the connecting plate 232 is also slid in the depth direction when there is sliding motion in the depth direction of the movable plate 231*b* of the sliding mechanism 231. A front portion of the connecting plate 232 is formed with an attachment plate 232*a* bent substantially into an L shape. The attachment plate 232*a* is formed with a locking groove 232*b* extending vertically. The locking groove 232*b* is formed so as to first extend downward from an upper end of the attachment plate 232*a*, further extend slightly in the forward direction from the lower end of the downwardly extending groove, and further extend downward from the front end of the forwardly extending groove. When both ends of the locking wire 213 are locked to the locking grooves 232*b*, the shelf plate 21 is connected to the sliding mechanism 231 via the locking wire 213 and the connecting plate 232. Thus, the shelf plate 21 is made slidable in the depth direction via the sliding mechanism 231 and the connecting plate 232.

Figure 4:
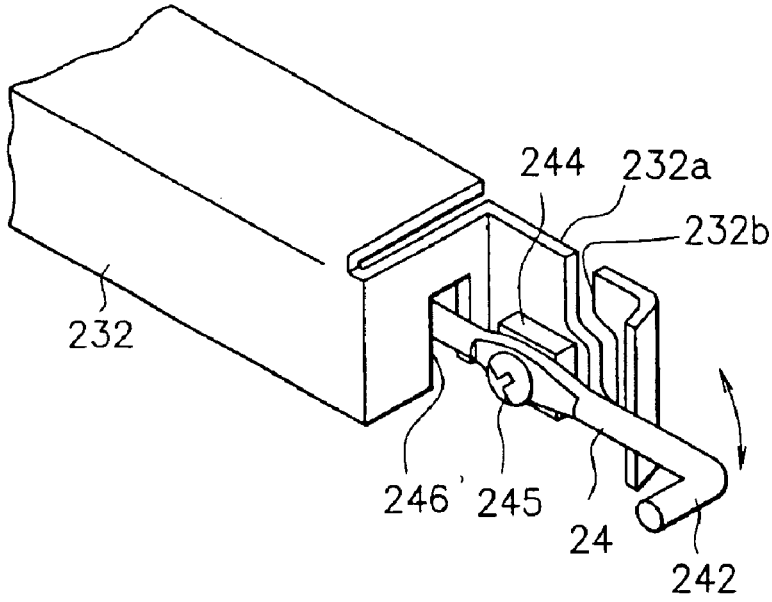
FIG. 4 is a perspective view of a locking member provided on a movable plate.
Figure 5:
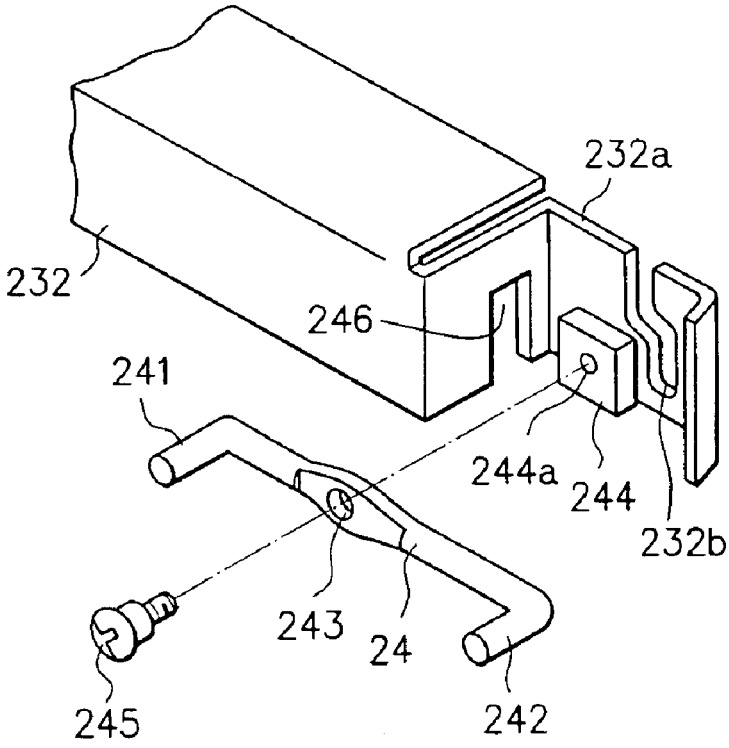
FIG. 5 is an exploded perspective view of the locking member.

The connecting plate 232 constructed as described above is provided with the locking member 24 as shown in FIGS. 4 and 5. This locking member 24 is formed of a hard rod. Both end portions of the locking member 24 are bent in the outward direction. At one end of the locking member 24, the locking portion 241 that can be locked to and unlocked from the concave portion 225 is provided, and at the other end thereof, an operating portion 242 that can be operated by hand is provided. In the center of the locking member 24 is provided a screw penetrating hole 243. Also, on a side face of the attachment plate 232*a* is provided an attachment block 244 having a screw hole 244*a*. When the locking member 24 is installed to the attachment block 244, a shank of a stepped screw 245 is inserted into the screw penetrating hole 243, and further the shank is screwed into the screw hole 244*a*. Thereby, the locking member 24 is attached to the attachment plate 232*a* so as to be turnable. Of the side faces of the attachment plate 232*a*, the other side face perpendicular to the side face on which the attachment block 244 is provided is formed with a notch groove 246 through which the locking member 24 penetrates. In front of the notch groove 246 is located the operating portion 242, and in rear thereof is located the locking portion 241. The locking portion 241 can be locked to and unlocked from the concave portion 225 as shown in FIG. 3. The center of gravity of the locking member 24 is located at a position closer to the operating portion 242 with respect to the rotation axis (stepped screw 245), so that an upward rotational force is applied to the locking portion 241. Thereby, the locking portion 241 is normally locked to the concave portion 225 as shown in FIG. 3.

Figure 6A:
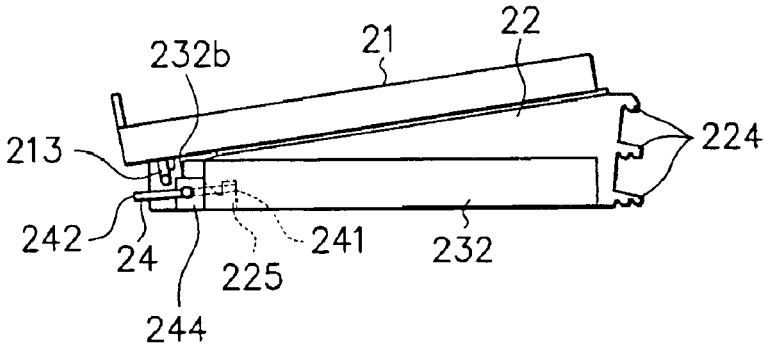
FIGS. 6A, 6B and 6C are side views showing sliding and removing operations of a shelf plate.

Next, the operation for pulling out the shelf apparatus 2 will be described mainly with reference to FIGS. 6A, 6B and 6C. When the shelf plate 21 is placed on the shelf supports 22, the locking portion 241 of the locking member 24 is locked to the concave portion 225 as shown in FIG. 6A. Thereby, the forward movement of the shelf plate 21 is restrained.

Figure 6B:
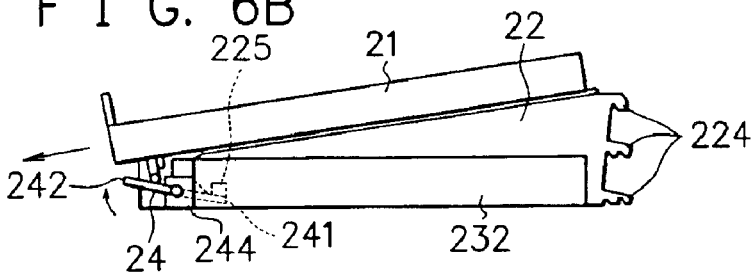

When the shelf plate 21 is pulled out forward, first, as shown in FIG. 6B, the operating portion 242 of the locking member 24 is turned upward. Thereby, as shown in FIG. 6B, the locking portion 241 of the locking member 24 is turned downward, and thus the locking portion 241 comes off the concave portion 225.

When the locked state of the locking member 24 is released, the shelf plate 21 is pulled forward. Thereby, as shown in FIG. 6C, the shelf plate 21 is pulled out forward by the sliding mechanism 231. Thus, commodities S1 can be resupplied onto the pulled-out shelf plate 21, for example, as in the case of the third shelf apparatus 2 from the upside of FIG. 1.

After the commodities resupplying work has been finished, the shelf plate 21 is pushed toward the farthest position of the shelf support 22. Thus, the locking portion 241 of the locking member 24 gets over the tip end portion of the shelf support 22, and is locked again to the concave portion 225 as shown in FIG. 6A.

Figure 6C:
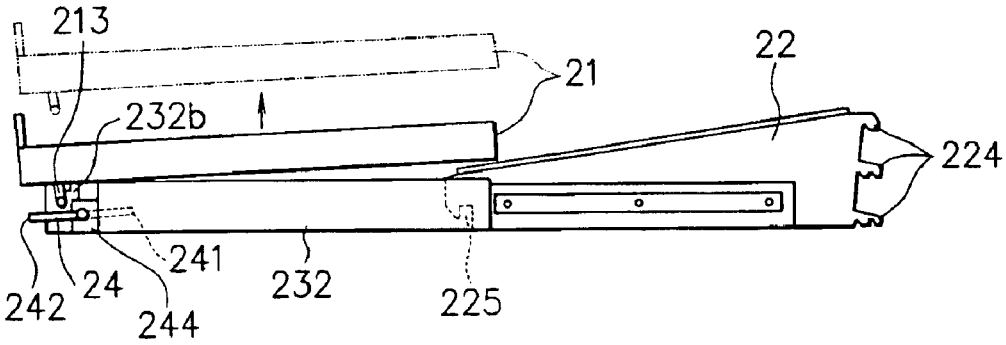

On the other hand, when the height position of the shelf apparatus 2 is changed, as shown in FIG. 6C, work for removing the shelf plate 21 is performed after the shelf plate 21 has been pulled out forward. Specifically, after the shelf plate 21 has been pulled out forward, the locking wire 213 is unlocked from the locking groove 232*b* while the shelf plate 21 is raised. Thereby, the shelf plate 21 is separated from the shelf support 22. After the work for separating the shelf plate 21 has been finished, the hooks 224 of the shelf support 22 are detached from the shelf pillar, and the shelf support 22 is installed at a location corresponding to a desired height position. Subsequently, the locking wire 213 of the shelf plate 21 is fitted again in the locking groove 232*b*, and the shelf plate 21 is pushed toward the farthest position of the showcase 1. By this series of work, the height position of the shelf apparatus 2 can be changed arbitrarily.

According to this embodiment, work for connecting the shelf plate 21 to the shelf support 22 and work for releasing the connection are performed by the turning operation of the locking member 24, so that the work may be very simple.

Also, since the locking member 24 is formed of a hard rod, and its strength is high, the locking strength with respect to the shelf plate 21 may be improved, and the locking member 24 may be used stably for a long period of time.

Further, since the shelf plate 21 can be separated from the shelf support 22 when the height position of the shelf apparatus 2 is changed, work for attaching/detaching the shelf support 22 and work for attaching/detaching the shelf plate 21 can be performed separately. Therefore, the work for changing the arrangement position of the shelf apparatus 2 may be easy to do, and the positioning of the shelf support 22 may be performed exactly.

Further, in the work for changing the arrangement position of the shelf apparatus 2, after the shelf plate 21 has been separated from the shelf support 22, the connecting plate 232 having been pulled out forward (in the state shown in FIG. 6C) can be pushed in again to the shelf support 22 side. By the work for pushing in the connecting plate 232, the connecting plate 232 and the sliding member 231 are stored on the inside of the shelf support 22, and at the same time, the locking member 24 is locked again to the concave portion 225, which prevents the connecting plate 232 from projecting forward. Therefore, the connecting plate 232 may not become a hindrance when the arrangement position of the shelf support 22 is changed.

In the above-described embodiment, the shelf apparatus 2 in which the shelf plate 21 is stored on the shelf supports 22 in an inclined state has been explained. Needless to say, however, the construction for regulating the sliding motion in accordance with the above-described embodiment can be applied to a shelf apparatus in which the shelf plate 21 is stored in a horizontal state (not shown). Also, in the above-described embodiment, the shelf support 22 is provided with the concave portion 225, and the connecting plate 232 is provided with the locking member 24. However, inversely, although not shown, the configuration may be such that the locking member 24 is provided on the shelf support 22, and the concave portion 225 is provided in the connecting plate 223. Further, in the above-described embodiment, the locking portion 241 is locked to the concave portion 225 with the locking member 24 being off-centered. However, the configuration may be such that a spring (not shown) for applying torque is installed to the locking member 24 to lock the locking portion 241 to the concave portion 225.

What is claimed is:

1. A shelf apparatus for a showcase, comprising:

a shelf plate on which commodities are placed;

a shelf support on which said shelf plate is supported; and a connecting member having a movable portion connected to said shelf plate and a fixed portion connected to said shelf support for enabling said shelf plate to slide in a depth direction, wherein one of the movable portion of said connecting member and said shelf support has a hard locking member, and the other has a locked portion which can lock and unlock said locking member, said locking member being formed of a turnable rod material extending from said movable portion to said shelf support, and at one end of said locking member is provided a locking portion which can be locked to and unlocked from said locked portion by the turning of said locking member, and at the other end of said locking member is provided an operating portion which can be turned by hand.

2. The shelf apparatus for a showcase according to claim 1, wherein said locked portion is a concave portion formed by cutting a lower end close to the front end of said shelf support.

3. The shelf apparatus for a showcase according to claim 2, wherein the center of gravity of said locking member is located at a position closer to said operating portion with respect to a rotation axis.

4. The shelf apparatus for a showcase according to claim 1, wherein the center of gravity of said locking member is located at a position closer to said operating portion with respect to a rotation axis.

5. The shell apparatus for a showcase according to claim 1, wherein a coming-off preventing plate of an L shape in cross section is provided on a lower surface of said shelf plate, and said shelf support is provided with a shelf guide plate for guiding said coming-off preventing plate in the depth direction while holding said coming-off preventing plate.

* * * * *

UNITED STATES PATENT AND TRADEMARK OFFICE

CERTIFICATE OF CORRECTION

PATENT NO. : 6,866,352 B2
DATED : March 15, 2005
INVENTOR(S) : Kiyoshi Fujii et al.

It is certified that error appears in the above-identified patent and that said Letters Patent is hereby corrected as shown below:

Column 6,
Line 53, change “shell” to -- shelf --.

Signed and Sealed this

Twenty-fourth Day of May, 2005

JON W. DUDAS
*Director of the United States Patent and Trademark Office*